US011192369B2

(12) United States Patent
Tanaka

(10) Patent No.: US 11,192,369 B2
(45) Date of Patent: Dec. 7, 2021

(54) LIQUID DISCHARGING HEAD

(71) Applicant: Brother Kogyo Kabushiki Kaisha, Nagoya (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 29 days.

(21) Appl. No.: 16/833,803

(22) Filed: Mar. 30, 2020

(65) Prior Publication Data

US 2020/0384766 A1 Dec. 10, 2020

(30) Foreign Application Priority Data

Jun. 5, 2019 (JP) ..... JP2019-105534

(51) Int. Cl.
*B41J 2/14* (2006.01)
*B41J 2/175* (2006.01)

(52) U.S. Cl.
CPC ..... *B41J 2/1433* (2013.01); *B41J 2/175* (2013.01)

(58) Field of Classification Search
CPC ..... B41J 2/1433; B41J 2/175; B41J 2002/14241; B41J 2002/14419; B41J 2002/14491; B41J 2002/14362; B41J 2/14233
USPC ..... 347/20
See application file for complete search history.

(56) References Cited

U.S. PATENT DOCUMENTS 9,193,162 B2 11/2015 Owaki et al.
2009/0231391 A1* 9/2009 Akahane ..... B41J 2/14274 347/47
2015/0130877 A1 5/2015 Takabe
2015/0165767 A1* 6/2015 Owaki ..... B41J 2/1433 347/54
2019/0001687 A1 1/2019 Sato et al.

FOREIGN PATENT DOCUMENTS

JP 2015-116707 A 6/2015
JP 2018-027711 A 2/2018
JP 2019-010860 A 1/2019

* cited by examiner

*Primary Examiner* — Huan H Tran
*Assistant Examiner* — Alexander D Shenderov
(74) *Attorney, Agent, or Firm* — Banner & Witcoff, Ltd.

(57) ABSTRACT

A liquid discharging head, having a plurality of individual flow paths, a common flow path, a first member, and a second member, is provided. Each of the individual flow paths includes a nozzle, a pressure chamber, and a connecting flow path arranged between the nozzle and the pressure chamber. The connecting flow path connects the nozzle with the pressure chamber. In the first member, a plurality of first holes each constituting the connecting flow path and a second hole constituting the common flow path are formed. The second member is arranged at a side of the connecting flow path opposite to the pressure chamber in an aligning direction, in which the nozzle, the connecting flow path, and the pressure chamber align with one another. The second member has a third hole that constitutes the common flow path but does not constitute the connecting flow path.

14 Claims, 7 Drawing Sheets

LIQUID DISCHARGING HEAD

CROSS REFERENCE TO RELATED APPLICATION

This application claims priority from Japanese Patent Application No. 2019-105534, filed on Jun. 5, 2019, the entire subject matters of which are incorporated herein by reference.

BACKGROUND

Technical Field

An aspect of the present disclosure is related to a liquid discharging head having a plurality of individual flow paths and at least one common flow path.

Related Art

A liquid jet head having a plurality of individual flow paths and a manifold ("common flow path") is known. Each of the individual flow paths may have a nozzle opening ("nozzle"), a pressure generating chamber ("pressure chamber"), and a nozzle communication path ("connecting flow path"). The common flow path and the individual flow paths may communicate. The liquid jet head may include a communication plate, in which through holes to constitute the connecting flow paths and a through hole to constitute the manifold are formed. At positions below the communication plate, a nozzle plate and a sealer sheet may be arranged. The nozzle plate may be arranged to face the connecting flow paths, and the sealer sheet may be arranged to face the manifold.

SUMMARY

If potential resistance producible in the common flow path is high, in particular, if the liquid to be discharged is viscous, the liquid may not be delivered sufficiently from the common flow path to the individual flow paths. In order to lower the potential resistance in the common flow path, the communication plate having the through hole that constitutes the common flow path may be thickened so that a cross-sectional area of the common flow path may be enlarged. However, thickening the communication plate may increase a length of the connecting flow paths at the same time. With the lengthened connecting flow paths, a propagation cycle of pressure waves of the liquid to be transmitted from the pressure chambers to the nozzles may be lengthened, which may lengthen a cycle for recording an image, and as a result, a recording speed may be lowered.

The present disclosure is advantageous in that a liquid discharging head, in which a length of each flow path from a pressure chamber to a nozzle may be restrained from increasing, while potential resistance in a common flow path may be reduced, is provided.

According to an aspect of the present disclosure, a liquid discharging head, having a plurality of individual flow paths, a common flow path, a first member, and a second member, is provided. Each of the individual flow paths includes a nozzle, a pressure chamber, and a connecting flow path arranged between the nozzle and the pressure chamber. The connecting flow path connects the nozzle with the pressure chamber. In the first member, a plurality of first holes each constituting the connecting flow path and a second hole constituting the common flow path are formed. The second member is arranged at a side of the connecting flow path opposite to the pressure chamber in an aligning direction, in which the nozzle, the connecting flow path, and the pressure chamber align with one another. The second member has a third hole that constitutes the common flow path but does not constitute the connecting flow path.

According to another aspect of the present disclosure, a liquid discharging head, having a first plate, a second plate, a third plate, and a fourth plate, is provided. The first plate has through holes, each of which constitutes a pressure chamber. The second plate has through holes, each of which constitutes a nozzle. The third plate is arranged between the first plate and the second plate. The third plate has through holes, each of which constitutes a connecting flow path that connects the pressure chamber with the nozzle, and a through hole constituting a common flow path. The fourth plate is arranged on a side of the third plate opposite to the second plate in an aligning direction, in which the first plate, the second plate, and the third plate align with one another. The fourth plate does not have a through hole to constitute the connecting flow path but has a through hole that constitutes the common flow path.

According to still another aspect of the present disclosure, a liquid discharging head, having a first plate, a second plate, and a third plate, is provided. The first plate has through holes, each of which constitutes a pressure chamber. The second plate has through holes, each of which constitutes a nozzle. The third plate is arranged between the first plate and the second plate. The third plate has through holes, each of which constitutes a connecting flow path that connects the pressure chamber with the nozzle, and a through hole constituting a common flow path. The second plate has a through hole constituting the common flow path.

BRIEF DESCRIPTION OF THE ACCOMPANYING DRAWINGS

Figure 4:
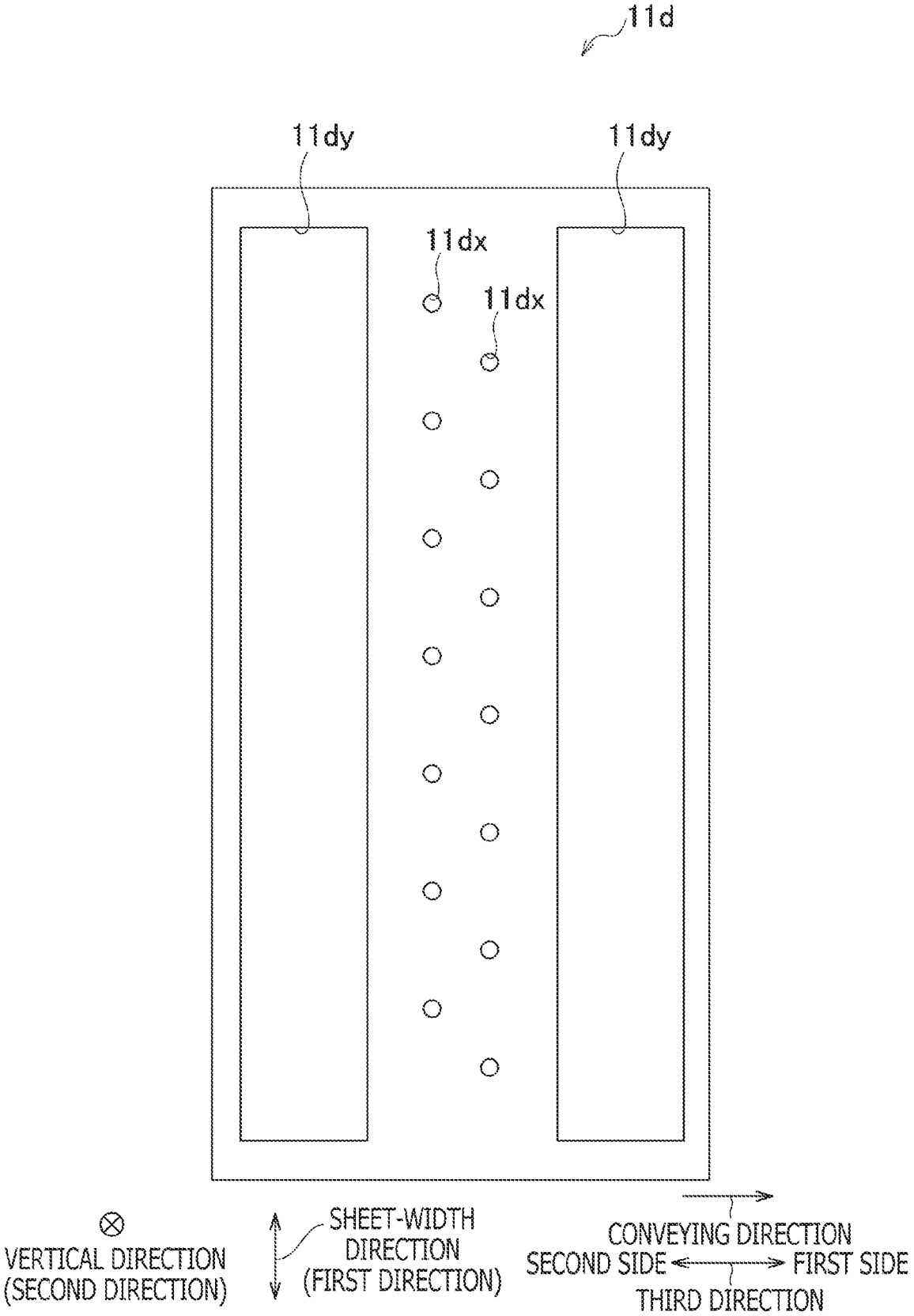

FIG. 4 is a plan view of a plate 11*d* forming a part of a flow path board 11 in the head 1 according to the first embodiment of the present disclosure.

Figure 5:
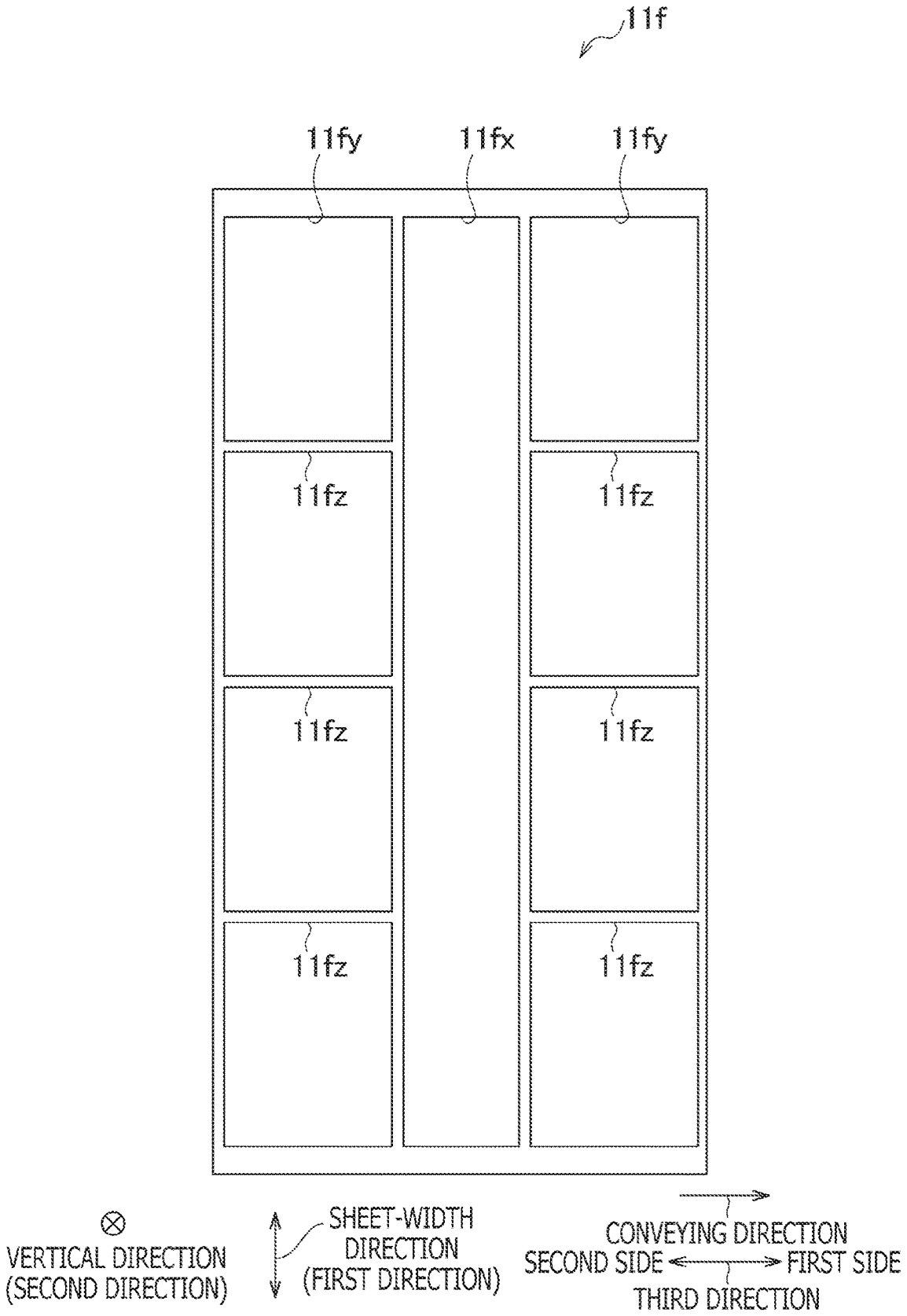

FIG. 5 is a plan view of a plate 11*f* forming another part of the flow path board 11 in the head 1 according to the first embodiment of the present disclosure.

Figure 3:
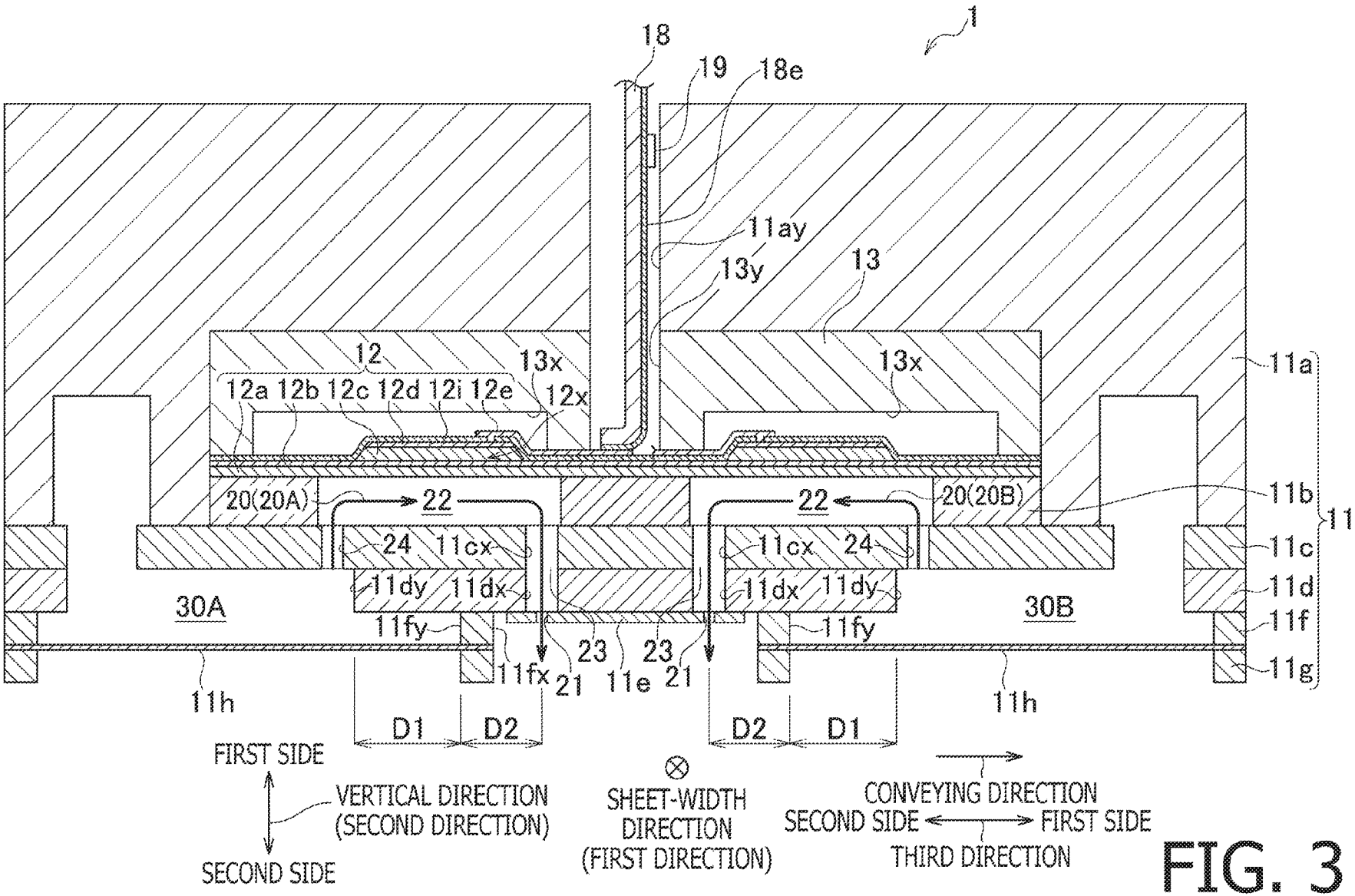
FIG. 3 is a cross-sectional view of the head 1 according to the first embodiment of the present disclosure viewed along a line shown in FIG. 2.
Figure 6:
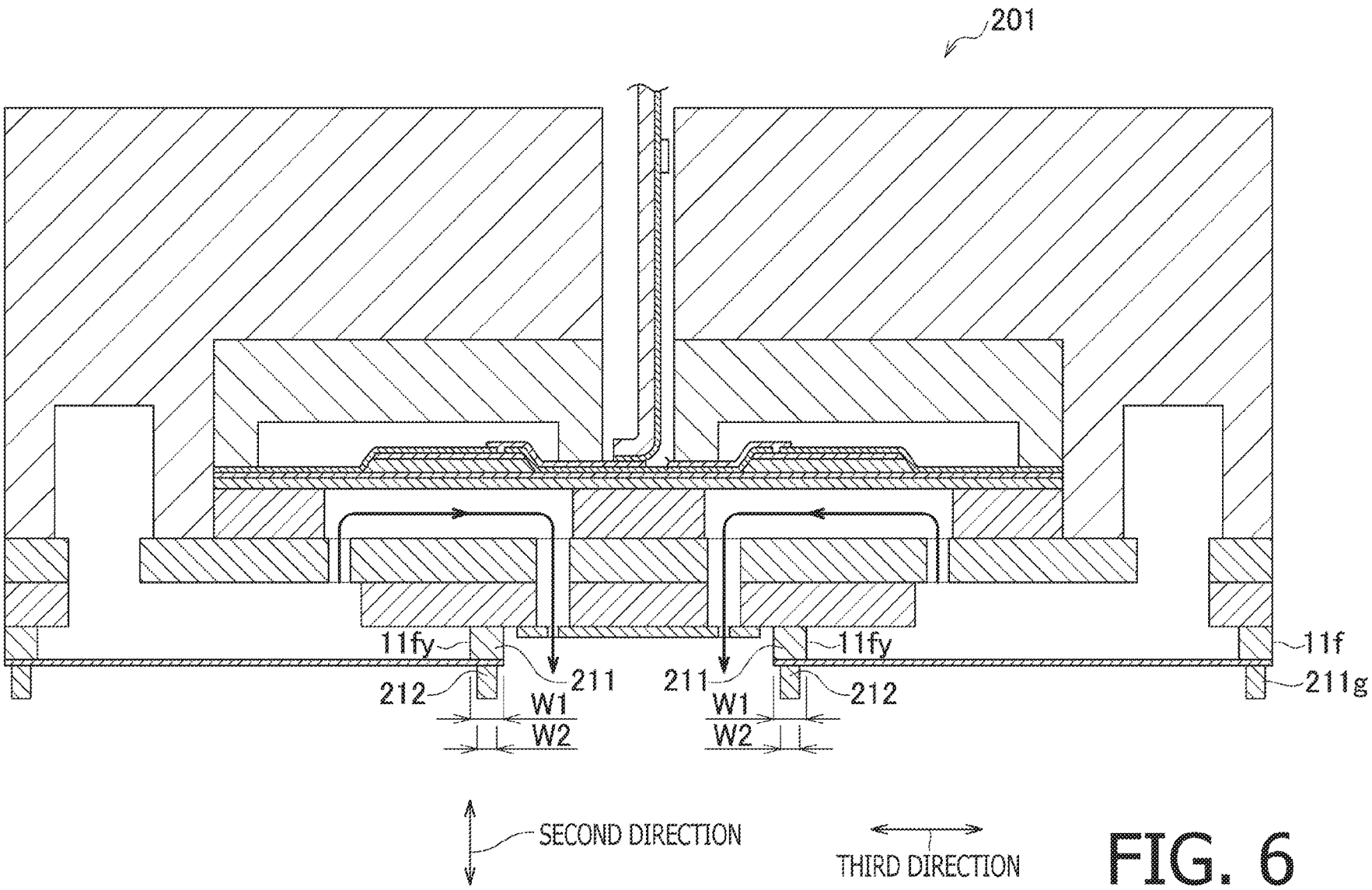

FIG. 6 is a cross-sectional view of a head 201 according to a second embodiment of the present disclosure viewed at a position equivalent to the head 1 shown in FIG. 3.

Figure 7:
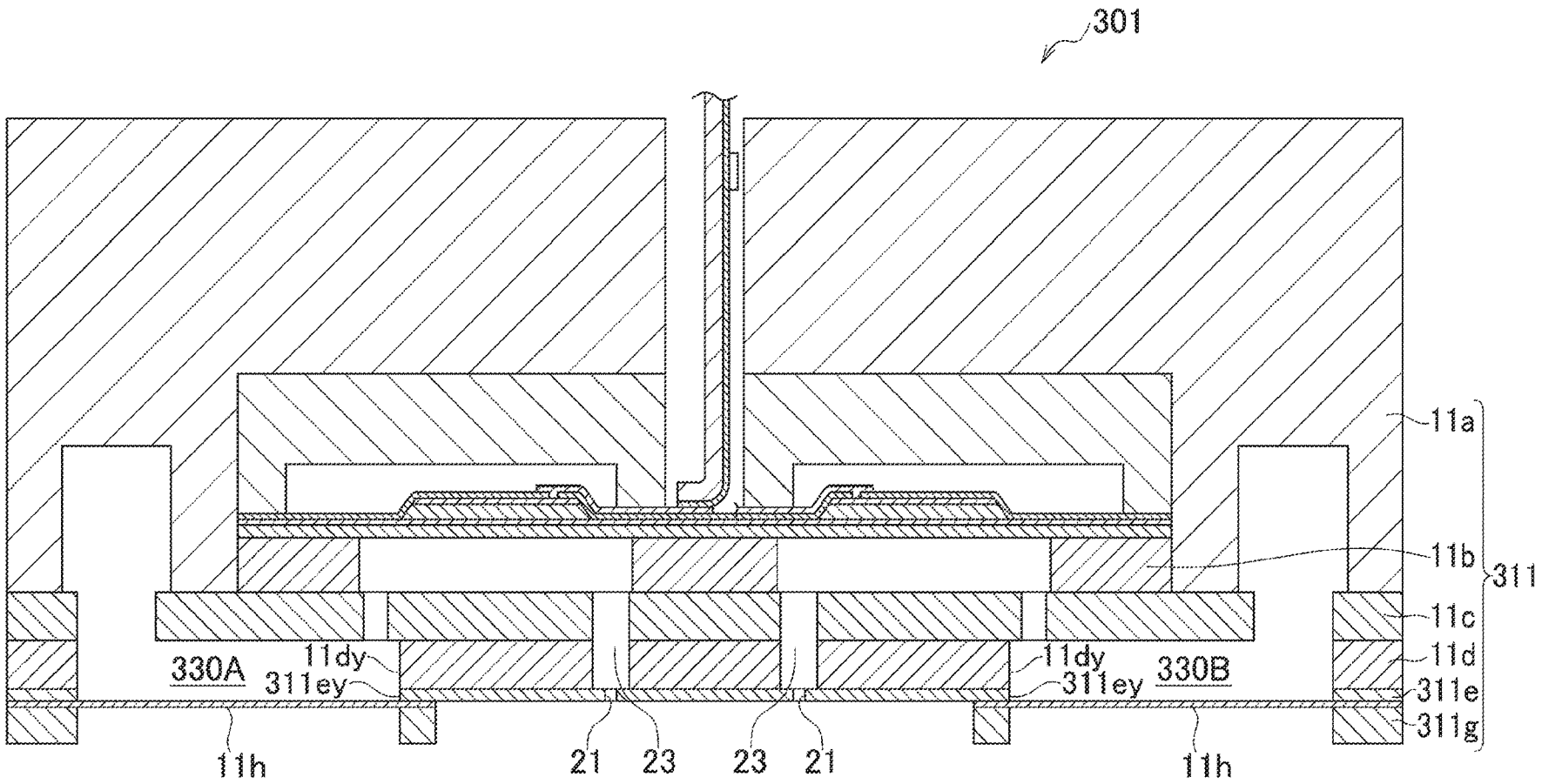

FIG. 7 is a cross-sectional view of a head 301 according to a third embodiment of the present disclosure viewed at a position equivalent to the head 1 shown in FIG. 3.

DETAILED DESCRIPTION

First Embodiment

Figure 1:
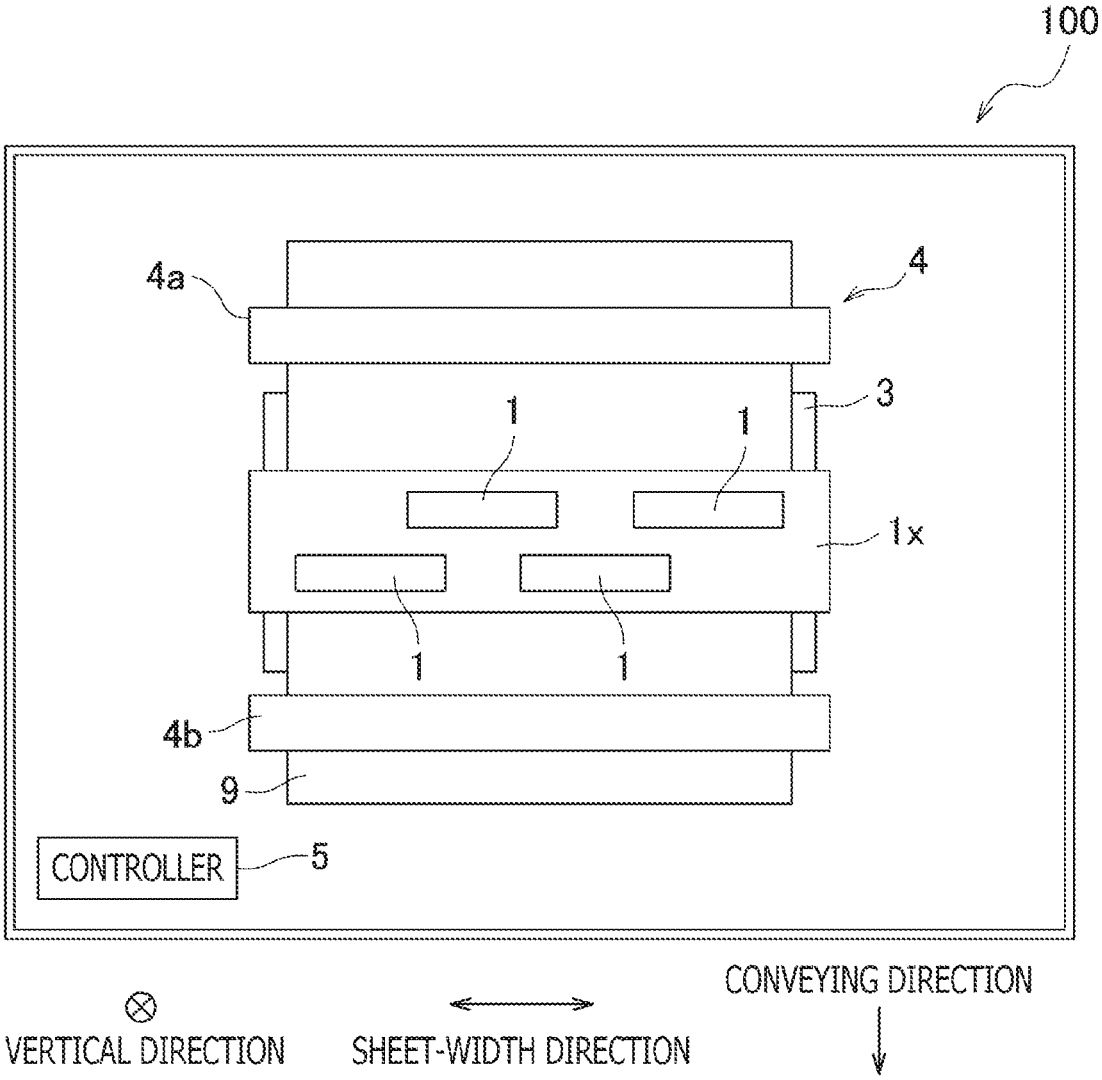
FIG. 1 is a plan view of a printer 100 having a head 1 according to a first embodiment of the present disclosure.

With reference to FIG. 1, described in the following paragraphs will be an overall configuration of the printer 100 having the head 1 according to the first embodiment of the present disclosure.

The printer 100 includes a head unit 1*x*, a platen 3, a conveyer 4, and a controller 5. The head unit 1*x* may include four (4) heads 1.

A sheet 9 may be set on top of an upper surface of the platen 3.

The conveyer 4 includes two (2) roller pairs 4*a*, 4*b*, which are arranged on one side and the other side of the platen 3 in a conveying direction. As a conveyer motor (not shown) operates under control of the controller 5, the roller pairs 4*a*, 4*b* may rotate so that the sheet 9 nipped between rollers in at least one of the roller pairs 4*a*, 4*b* may be conveyed in the conveying direction.

The head unit 1*x* is a line-printing inkjet head extending longitudinally in a sheet-width direction, which intersects orthogonally to the conveying direction and to a vertical direction. The head unit 1*x* may discharge ink at the sheet 9 through nozzles 21 (see FIGS. 2 and 3) while being situated at a fixed position. The heads 1 in the head unit 1*x*, each extending longitudinally in the sheet-width direction, are arrayed alternately in zigzag along the sheet-width direction.

The controller 5 includes a Read Only Memory (ROM), a Random Access Memory (RAM), and an Application Specific Integrated Circuit (ASIC). The ASIC may execute processes including a recording process in accordance with programs that are stored in the ROM. In the recording process, the controller 5 may control a driver IC 19 (see FIG. 3) and the conveyer motor (not shown) for each head 1 to record an image on the sheet 9.

Next, with reference to FIGS. 2-5, described below will be a representing one of the heads 1.

The head 1 includes, as shown in FIG. 3, a flow path board 11, an actuator board 12, a protector board 13, and a wiring board 18.

The flow path board 11 includes a reservoir member 11*a*, six (6) pieces of plates 11*b*-11*g*, and two (2) damper sheets 11*h*.

The plates 11*b*-11*g* are layered in the vertical direction and are adhered to one another. A width of a topmost plate 11*b* among the six plates 11*b*-11*g* is smaller than a width of the plate 11*c*, which is second from the top. The reservoir member 11*a*, which may be, for example, made of resin and formed in mold injection, is adhered to an upper face of the plate 11*c*, in areas where no plate 11*b* is adhered. The damper sheets 11*h* are interposed between the plate 11*f* and the plate 11*g*.

The palates 11*b*-11*g* may be made of, for example, resin such as liquid crystal polymer (LCP) or metal such as stainless steel (SUS). The damper sheets 11*h* may be made of, for example, resin such as polyphenylene sulfide (PPS) or metal such as stainless steel (SUS).

In the reservoir member 11*a*, upstream portions of two (2) common flow paths 30A, 30B are formed. In the plates 11*b*-11*f*, through holes that constitute flow paths including downstream portions of the common flow paths 30A, 30B and a plurality of individual flow paths 20 are formed.

Figure 2:
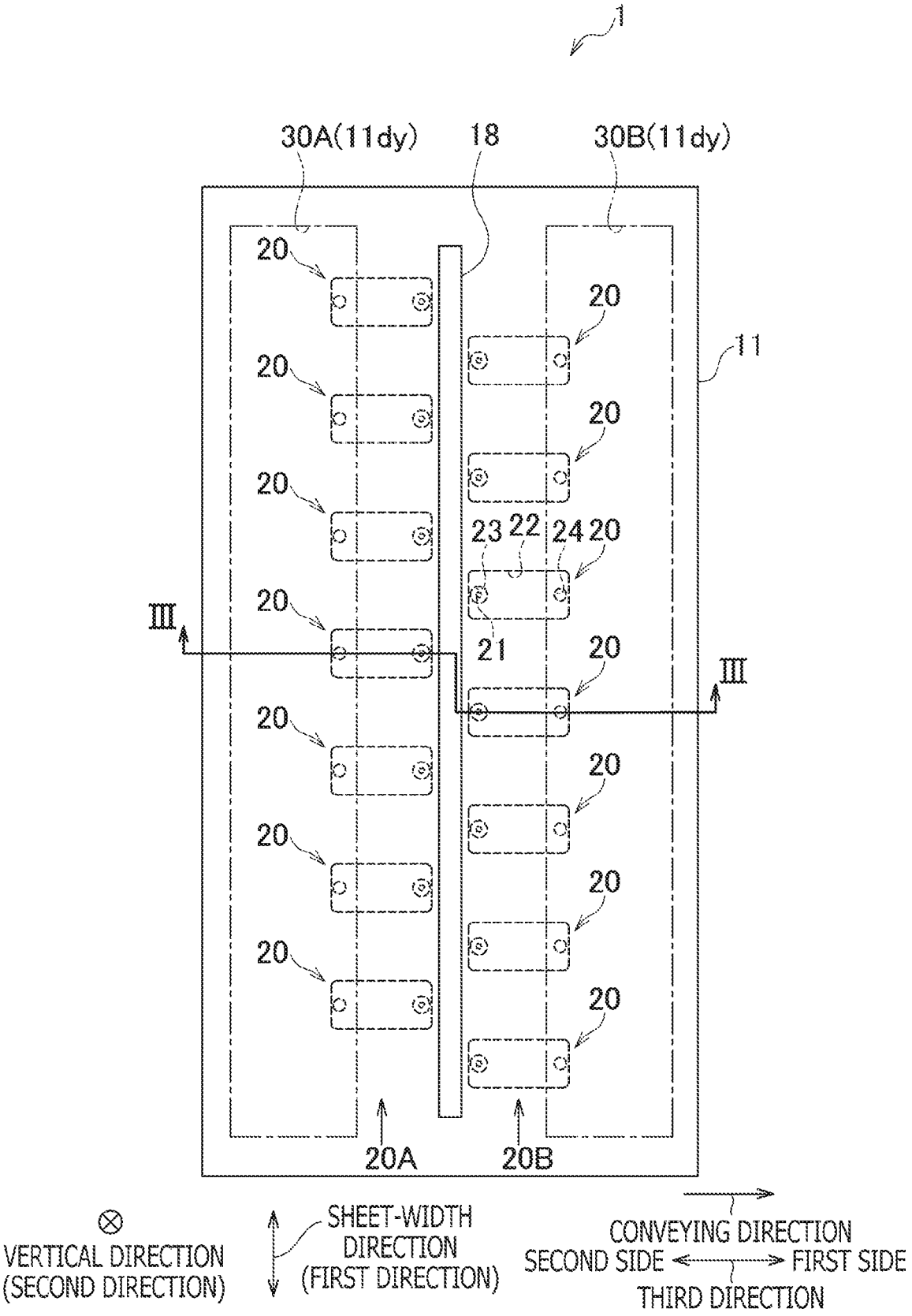
FIG. 2 is a plan view of the head 1 according to the first embodiment of the present disclosure.

The plurality of individual flow paths 20 are, as shown in FIG. 2, arrayed alternately in zigzag along a first direction, e.g., the sheet-width direction, and form a first individual flow path group 20A and a second individual flow path group 20B. The first individual flow path group 20A and the second individual flow path group 20B, each include a plurality of individual flow paths 20 that are arrayed in line in the first direction. The first individual flow path group 20A and the second individual flow path group 20B are arranged at a same height in a second direction, e.g., the vertical direction, and align with each other in a third direction, which is parallel to the conveying direction. The second direction coincides with a direction of height of the common flow paths 30A, 30B and intersects orthogonally with the first direction. The third direction coincides with a widthwise direction of the common flow paths 30A, 30B and intersects orthogonally with the first direction and with the second direction.

The common flow paths 30A, 30B longitudinally extend in the first direction and align side-by-side in the third direction.

The common flow paths 30A, 30B communicate with a subsidiary tank (not shown). The subsidiary tank communicates with a main tank (not shown) and stores ink supplied from the main tank. The ink in the subsidiary tank may be conveyed by a pump (not shown) being operated under the control of the controller 5 to flow into the common flow paths 30A, 30B. The ink entering the common flow path 30A may flow from one end to the other end of the common flow path 30A in the first direction and may be supplied to the individual flow paths 20 in the first individual flow path group 20A. The ink entering the common flow path 30B may flow from one end to the other end of the common flow path 30B in the first direction and may be supplied to the individual flow paths 20 in the second individual flow path group 20B.

Each of the individual flow paths 20 includes, as shown in FIG. 3, a nozzle 21, a pressure chamber 22, a connecting flow path 23, and an inflow path 24. The nozzle 21, the connecting flow path 23, and the pressure chamber 22 align with one another in the second direction to at least partly overlap one another.

Each nozzle 21 is, as shown in FIG. 3, formed of a through hole, which is formed in the plate 11*e*, and is open downward from a downward face of the flow path board 11.

Each pressure chamber 22 is, as shown in FIG. 3, formed of a through hole, which is formed in the plate 11*b*, and is open upward from an upward face of the plate 11*b*. The pressure chamber 22 is arranged at an upper position on one side, e.g., toward a first side (see FIG. 3) in the second direction, with respect to the nozzle 21.

The pressure chamber 22 is formed substantially in a rectangular shape, extending longer in the third direction, on a plane that spreads in parallel with the first direction and the third direction, in other words, on a plane intersecting orthogonally to the second direction. The pressure chamber 22 communicates with one of the common flow path 30A and the common flow path 30B through the inflow path 24 at one end thereof in the third direction and with the connecting flow path 23 at the other end thereof in the third direction.

The connecting flow path 23 is formed of, as shown in FIG. 3, a through hole 11*cx*, which is formed in the plate 11*c*, and a through hole 11*dx*, which is formed in the plate 11*d*, and extends in the second direction. In the second direction, the connecting flow path 23 is located between the nozzle 21 and the pressure chamber 22 and connects the nozzle 21 with the pressure chamber 22. In the third direction, the connecting flow path 23 is connected with the pressure chamber 22 at the other end of the pressure chamber 22, opposite to the one end at which the inflow path 24 is connected with the pressure chamber 22.

The inflow path 24 is, as shown in FIG. 3, formed of a through hole, which is formed in the plate 11*c*, and extends in the second direction. The inflow path 24 has an upper end, at which the inflow path 24 is connected with the one end of the pressure chamber 22 in the third direction, and a lower end, at which the inflow path 24 is connected with one of the common flow path 30A and the common flow path 30B.

The inflow path 24 has a width, i.e., a length in the first direction, smaller than a width of the pressure chamber 22 and may function as a funnel.

As shown in FIG. 2, each of the pressure chambers 22 belonging to the first individual flow path group 20A has a portion, which overlaps the common flow path 30A in the second direction and a portion, which does not overlap the common flow path 30A in the second direction but is located between the common flow path 30A and the common flow path 30B in the third direction. Each of the pressure chambers 22 belonging to the second individual flow path group 20B has a portion, which overlaps the common flow path 30B in the second direction and a portion, which does not overlap the common flow path 30B in the second direction but is located between the common flow path 30A and the common flow path 30B in the third direction.

The connecting flow paths 23 and the nozzles 21 belonging to the first individual flow path group 20A are located sideward with respect to the common flow path 30A toward a first side (see FIG. 3) in the third direction. The connecting flow paths 23 and the nozzles 21 belonging to the second individual flow path group 20B are located sideward with respect to the common flow path 30A toward a second side (see FIG. 3) in the third direction.

The actuator board 12 includes, as shown in FIG. 3, a vibration board 12*a*, a common electrode 12*b*, a plurality of piezoelectric devices 12*c*, and a plurality of individual electrodes 12*d*, from bottom to top in this given order.

The vibration board 12*a* and the common electrode 12*b* are arranged on an upper face of the plate 11*b* to cover all of the pressure chambers 22 formed in the plate 11*b*. Meanwhile, the piezoelectric devices 12*c* and the individual electrodes 12*d* are each provided to each one of the pressure chambers 22. In other words, the piezoelectric devices 12*c*, the individual electrodes 12*d*, and the pressure chambers 22 are in one-to-one correspondence mutually. The piezoelectric devices 12*c* and the individual electrodes 12*d* are arranged to overlap the corresponding pressure chambers 22 in the third direction.

The actuator board 12 further includes an insulation sheet 12*i* and a plurality of individual wires 12*e*.

The insulation sheet 12*i* may be made of, for example, silicon dioxide ($SiO_2$) and covers a part of an upper face of the common electrode 12*d* where no piezoelectric device 12*c* is arranged, sideward faces of the piezoelectric devices 12*c*, and upper faces of the individual electrodes 12*d*. Through holes are formed in the insulation sheet 12*i* at positions coincident with the individual electrodes 12*d* in the second direction.

The individual wires 12*e* are arranged on the insulation sheet 12*i* with downward ends thereof being inserted in the through holes formed in the insulation sheet 12*i* so that the downward ends of the individual wires 12*e* contact the corresponding individual electrodes 12*d*. Thus, the individual wires 12*e* are each electrically connected with one of the individual electrodes 12*d*. The individual wires 12*e* extend in the third direction to a center of the actuator board 12 in the third direction.

To an upper face of the actuator board 12, at a position coincident with the center of the actuator board 12 in the third direction, arranged is one end of the wiring board 18. The other end of the wiring board 18 is connected to the controller 5. Between the one end and the other end of the wiring board 18, mounted is the driver IC 19.

The wiring board 18 may include, for example, Chip On Film (COF) and extends in the first direction on the upper face of the actuator board 12 (see FIG. 2). The wiring board 18 includes a plurality of individual wires 18*e* (see FIG. 3), which are each electrically connected with each one of the individual wires 12*e*, and a common wire (not shown). The common wire is electrically connected with the common electrode 12*b* through a through hole formed in the insulation sheet 12*i*.

The driver IC 19 is electrically connected with each of the individual electrodes 12*d* through the individual wires 18*e* and with the common electrode 12*b* through the common wire. The driver IC 19 may maintain potential in the common electrode 12*b* at a ground potential and, on the other hand, change potentials in the individual electrodes 12*d*. In particular, the driver IC 19 may generate driving signals based on controlling signals from the controller 5 and apply the generated driving signals to the individual electrodes 12*d* individually. Thereby, the potentials in the individual electrodes 12*d* may individually change between a predetermined driving potential and the ground potential. As the potential in the individual electrode 12*d* changes, a part of the vibration board 12*a* and the piezoelectric device 12*c* interposed between the individual electrode 12*d* having the changed potential and the pressure chamber 22, i.e., the actuator 12*x*, may deform to dent into the pressure chamber 22, and a capacity of the pressure chamber 22 changes so that the ink in the pressure chamber 22 may be pressurized and discharged through the nozzle 21.

As the ink is discharged through the nozzles 21, ink to refill the pressure chambers 22 may be supplied to the individual flow paths 20 through common flow paths 30A, 30B. In particular, as shown in FIG. 3, the ink may be conveyed upward from the common flow paths 30A, 30B through the inflow paths 24 and flow in the pressure chambers 22 through the one ends of the pressure chambers 22 in the third direction. The ink may flow substantially horizontally from the one end to the other end of the pressure chamber 22 in the third direction, e.g., inward, and flow downward through the connecting flow path 23 to be discharged through the nozzle 21.

The protector board 13 is adhered to an upper face of the actuator board 12. The protector board 13 includes two (2) raised portions 13*x* and a through hole 13*y*.

The raised portions 13*x* extend longitudinally in the first direction. In one of the raised portions 13*x*, the actuators 12*x* corresponding to the first individual flow path group 20A are accommodated. In the other of the raised portions 13*x*, the actuators 12*x* corresponding to the second individual flow path group 20B are accommodated.

The through hole 13*y* extends in the first direction at a center of the protector board 13 in the third direction. Meanwhile, in the reservoir member 11*a* arranged on an upper face of the protector board 13, at a position to coincide with the through hole 13*y* in the second direction, formed is a through hole 11*ay*. The wiring board 18 extends in the second direction in the through hole 13*y* and the through hole 11*ay*.

Next, with reference to FIGS. 3-5, described below will be more detailed configuration of the common flow paths 30A, 30B.

The plate 11*d* is, as shown in FIGS. 3 and 4, formed to have a plurality of through holes 11*dx*, each of which constitutes one of the connecting flow paths 23 in the individual flow paths 20, and two (2) through holes 11*dy*, each of which constitutes one of the common flow paths 30A, 30B. As shown in FIG. 4, the though holes 11*dy* are each in a rectangular shape longitudinally extending in the first direction. Meanwhile, the plurality of through holes 11*dx* are arranged between the through holes 11*dy* in the third direction. In other words, the through holes 11*dy* constitute the common flow path 30A or 30B but do not constitute the connecting flow path 11*dy*.

As shown in FIG. 3, the inflow path 24 in each individual flow path 20 is located directly above the through hole 11*dy*. The inflow path 24 communicates with the through hole 11*dy* and overlaps the through hole 11*dy* in the second direction.

The plates 11*e*, 11*f* are, as shown in FIG. 3, arranged on a lower side of the plate 11*d* and are adhered to a downward face of the plate 11*d*. In other words, the plates 11*e*, 11*f* are located toward a second side (see FIG. 3) in the second direction with respect to the connecting flow paths 23.

In the plate 11*f*, as shown in FIGS. 3 and 5, a through hole 11*fx*, two (2) through holes 11*fy*, and bars 11*fz* are formed. The through hole 11*fx* accommodates the plate 11*e* therein. The through holes 11*fy* each constitute the common flow paths 30A, 30B. The bars 11*fx* divide the through holes 11*f* into a plurality of smaller holes. As shown in FIG. 5, the through hole 11*fx* longitudinally extends in the first direction at a center of the plate 11*f* in the third direction. The through holes 11*fy* are formed on one side and the other side of the through hole 11*fx* in the third direction. In other words, the through hole 11*fx* is arranged between the through holes 11*fy* in the third direction. The through holes 11*fx*, 11*fy* are, similarly to the through holes 11*dy*, each in a rectangular shape longitudinally extending in the first direction. In each of the through holes 11*y*, three (3) bars 11*fz* are arranged to be spaced apart equally from one another in the first direction. The bars 11*fz* extend in the third direction and divide the through hole 11*fy* into three (3) zones.

The through holes 11*fy*, as shown in FIG. 3, do not constitute the connecting flow paths 23. The through holes 11*fy* each communicate with either one of the through holes 11*dy*. In other words, the through holes 11*fy* and the through holes 11*dy* are in one-to-one correspondence. Each through hole 11*fy* overlaps the corresponding one of the through holes 11*dy* in the second direction.

The through holes 11*fy* are each marginally larger than the corresponding through holes 11*dy* in the first direction and in the third direction (see FIGS. 4 and 5). Edges of each through hole 11*fy* are located outward with respect to edges of the corresponding one of the through holes 11*dy* in the first direction and the third direction (see FIG. 3) to encompass outlines of the through hole 11*dy* entirely in a plan view.

A distance D1 between an edge of the through hole 11*fy* and an edge of the through hole 11*dy*, in a range that overlaps the pressure chamber 22 in the second direction, is greater than a distance D2 between the edge of the through hole 11*fy* and the nozzle 21. For example, the distance D1 may be 400-500 μm and the distance D2 may be 300-400 μm.

The plate 11*e* is arranged on a downward face of the plate 11*d* at a center of the plate 11*d* in the first direction and the third direction and is accommodated in the through hole 11*fx*. The plate 11*e* is marginally smaller than the through hole 11*fx* in a plan view on a plane parallel to the first direction and to the third direction, i.e., on a plane orthogonal to the second direction.

A thickness, or a length in the second direction, of the plate 11*f* is greater than a thickness, or a length in the second direction, of the plate 11*e*. For example, the thickness of the plate 11*f* may be 100-200 μm, and the thickness of the plate 11*e* may be 75 μm.

The two (2) damper sheets 11*h* are each arranged on a lower side of the plate 11*f* and adhered to a downward face of the plate 11*f* at peripheral edges of the through holes 11*fy* to close the through holes 11*fy*. A thickness, or a length in the second direction, of each damper sheet 11*h* may be, for example, 20 μm or thinner. The damper sheets 11*h* may attenuate pressure fluctuation of the ink in the common flow paths 30A, 30B.

The plate 11*g* is located on a lower side of the plate 11*f* across the damper sheets 11*h*. The plate 11*g* is arranged to interpose peripheral edges of the damper sheets 11*h* between the plate 11*g* and the plate 11*f* in the second direction. In other words, the plate 11*g* is arranged on a side of the plate 11*f* opposite to the plate 11*d* in the second direction.

The plate 11*g* may be made of the same material as the plate 11*f*. For example, the plate 11*g* may be made of resin such as LCP being low-expansive resin or metal such as SUS.

Meanwhile, it may be preferable that the plate 11*f* is made of a material which is rigid and difficult to crack in order to resist the pressure that may be applied to the plate 11*f* when the plate 11*f* is adhered to the plate 11*d*. Moreover, in order to achieve and maintain adherence between the plate 11*f* and the plate 11*d* preferably, it is desirable that a difference between linear expansion coefficients of the plate 11*f* and the plate 11*d* is smaller.

In a manufacturing procedure of the flow path board 11, for example, a first part, which excludes the plates 11*f*, 11*g* and the damper sheets 11*h*, and a second part, which includes the plates 11*f*, 11*g* interposing the damper sheets 11*h* there-between, may be assembled separately. Thereafter, the second part may be adhered to the first part: in particular, an upper face of the plate 11*f* in the second part may be adhered to a lower face of the plate 11*d* in the first part. In this procedure, compared to, for example, a manufacturing procedure; in which the plate 11*f* is adhered to the lower face of the plate 11*d*, thereafter the damper sheets 11*h* are attached to the lower face of the plate 11*f*, and further the plate 11*g* is adhered to the lower face of the plate 11*f* with the damper sheets 11*h* interposed between the plate 11*f* and the plate 11*g*, a number of adhering operations may be reduced. While the plate 11*d* may bear the adhering pressure each time the plates 11*f*, 11*g*, and the damper sheets 11*h* are adhered thereto either directly or indirectly, by reducing the number of adhering operations, the plate 11*d* may be restrained from being damaged. Moreover, while the plate 11*f* has the through holes 11*fx*, 11*fy*, and the plate 11*g* has the through holes to coincide with the through holes 11*fx*, 11*fy*, adhesive areas in the plate 11*f*, 11*g* may be reduced; therefore, the adhering pressure may be applied to the reduced adhesive areas concentratively. In this regard, with the reduced number of adhering operations, the plates 11*f*, 11*g* may also be restrained from being damaged.

As has been described, while the plate 11*d* is formed to have the through holes 11*dx* that constitute the connecting flow paths 23 and the through holes 11*dy* that constitute the common flow paths 30A, B, at the position on the lower side of the plate 11*d*, arranged is the plate 11*f*, in which the through holes 11*fy* that constitute the common flow paths 30A, 30B but do not constitute the connecting flow paths 23 are formed (see FIG. 3). Therefore, without increasing the thickness of the plate 11*d*, cross-sectional areas of the common flow paths 30A, 30B may be increased. Thus, while the length between the pressure chamber 22 and the nozzle 21 may be restrained from increasing, potential resistance in the common flow paths 30A, 30B may be lowered.

The damper sheets 11*h* are arranged on the lower side of the plate 11*f* to close the through holes 11*fy* (see FIG. 3). Therefore, the damper sheets 11*h* may provide an attenuating affect to the liquid in the common flow paths 30A, 30B so that the liquid may be stably supplied to the individual flow paths 20 from the common flow paths 30A, 30B.

The edges of each through holes 11*fy* are located on the outer sides with respect to the edges of the through holes 11*dy* (see FIG. 3). In this arrangement, compared to an arrangement, in which the edges of the through holes 11*fy* coincide with the edges of the through holes 11*dy*, or in which the edges of the through holes 11*fy* are located on the inner sides of the edges of the through holes 11*dy*, a movable range of the damper sheets 11*h* may be enlarged so that the attenuation effect may be enhanced.

The edges of the through holes 11*fy* encompass the outlines of the through holes 11*dy* entirely in a plan view (see FIG. 3). In this arrangement, compared to an arrangement, in which merely a part of the edges of the through hole 11*fy* is located on an outer side of the edge of the through hole 11*dy*, the movable range of the damper sheet 11*h* may be enlarged more securely so that the attenuation effect may be enhanced.

The through hole 11*fy* has the similar shape, e.g., rectangular shape, to the through hole 11*dy* (see FIGS. 4 and 5). Due to this similarity, the arrangement, in which the edges of the through hole 11*fy* encompass the outline of the through hole 11 entirely may be achieved easily.

The distance D1 between the edge of the through hole 11*fy* and the edge of the through hole 11*dy*, in the range that overlaps the pressure chamber 22 in the second direction, is greater than the distance D2 between the edge of the through hole 11*fy* and the nozzle 21 (see FIG. 3). In this arrangement, the movable range of the damper sheet 11*h* may be enlarged so that the attenuation effect may be enhanced more effectively.

The plate 11*g* is arranged to interpose the peripheral edges of the damper sheets 11*h* between the plate 11*g* and the plate 11*f* in the second direction (see FIG. 3). In this arrangement, the plate 11*g* may restrain the damper sheets 11*h* from being detached from the plate 11*f*.

The plate 11*g* may be made of the same material as the plate 11*f*. In this arrangement, the manufacturer may administer the material more easily, and as a result, a manufacturing cost may be lowered.

The plate 11*g* may have the same size and shape as the plate 11*f*. In this arrangement, the plate 11*g* and the plate 11*f* may not be formed in different patterns but may be manufactured simply in the same pattern.

The thickness of the plate 11*f* is greater than the thickness of the plate 11*e* (see FIG. 3). In this arrangement, compared to an arrangement, in which the thickness of the plate 11*f* is smaller than or equal to the thickness of the plate 11*e*, the length of the through hole 11*fy* in the second direction may be increased, and the cross-sectional areas of the common flow paths 30A, 30B may be increased. Moreover, the plate 11*f* may protect the nozzles 21 so that the plate 11*f* may restrain the sheet 9, or the like, from colliding with the nozzles 21. Meanwhile, if the thickness of the plate 11*f* is excessively increased, a wiper (not shown) to wipe the lower face of the plate 11*e* may collide with the plate 11*f*, and the plate 11*e* may not be wiped clearly. In this regard, a preferable thickness of the plate 11*f* may be 100-200 μm.

The plate 11*f* further includes the bars 11*fz*, which divide the through hole 11*y* into smaller zones (see FIG. 5). In this arrangement, compared to a through hole without the bars 11*fz*, rigidity of the plate 11*f* may be improved, and the plate 11*f* may be prevented from being damaged.

Second Embodiment

Next, with reference to FIG. 6, described below will be a head 201 according to a second embodiment of the present disclosure.

While in the first embodiment (see FIG. 3) the plate 11*g* has the same size and shape as the plate 11*f*, in the second embodiment, as shown in FIG. 6, a plate 211*g* may have a shape similar to the plate 11*f*, but a size of the plate 211*g* is marginally smaller than the plate 11*f*.

While the plate 11*f* has a first wall 211 to define the through hole 11*fy*, the plate 211*g* has a second wall 212, which overlaps a part of the first wall 211 in the second direction. A width W1, which is a dimension of the first wall 211 in the third direction, is greater than a width W2, which is a dimension of the second wall 212 in the third direction. The width W1 may be, for example, 100-150 μm, and the width W2 may be, for example, 50-100 μm.

According to this arrangement, although the arrangement of the plate 212*g* may be different from the plate 11*g*, the benefits achievable by the head 1 in the first embodiment may be similarly achievable through the head 201 as long as the other conditions in the second embodiment are satisfied similarly to the first embodiment.

Moreover, in the second embodiment, the width W1 of the first wall 211 is greater than the width W2 of the second wall 212. While the plate 211*g* is being adhered to the plate 11*f*, the plate 211*g* may be displaced to some extent in the third direction. In this regard, even if the plate 211*g* is displaced in the third direction, the difference between the width W1 and the width W2 may absorb the displacement, and the second wall 212 may be stably adhered to the first wall 211.

Third Embodiment

Next, with reference to FIG. 7, described below will be a head 301 according to a third embodiment of the present disclosure.

While in the first embodiment (see FIG. 3) the plate 11*f* is provided separately from the plate 11*e* being the nozzle plate, in the third embodiment, the plate 11*f* is omitted. Moreover, in the third embodiment, a plate 311*e* functioning as a nozzle plate is formed to have through holes 311*ey*, which does not constitute the connecting flow paths 23 but each constitutes one of the common flow paths 330A, 330B.

In the third embodiment, a flow path board 311 includes the reservoir member 11*a*, five (5) pieces of plates 11*b*-11*d*, 311*e*, 311*g*, and two (2) damper sheets 11*h*.

While in the first embodiment the edges of the through holes 11*fy* are located on the outer sides of the edges of the through holes 11*dy* (see FIG. 3), in the third embodiment, edges of the through holes 311*ey* coincide with the edges of the through holes 111*dy*. Therefore, in the third embodiment, a movable range of the damper sheets 11*h* may be smaller than the movable range of the damper sheets 11*h* in the first embodiment.

According to this arrangement, although the arrangement of the plate 311*e* may be different from the plate 11*f*, the benefits achievable by the head 1 in the first embodiment may be similarly achievable through the head 301 as long as the other conditions in the third embodiment are satisfied similarly to the first embodiment.

Moreover, the head 301 in the third embodiment has the plate 311*e* being the nozzle plate. Therefore, a manufacturer manages may not necessarily prepare another member separately from the nozzle plate. In other words, a quantity of parts may be reduced, and the head 301 may be produced more easily.

More Examples

Although examples of carrying out the invention have been described, those skilled in the art will appreciate that there are numerous variations and permutations of the liquid discharging head that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, materials for the plates 11*d*, 11*f*, 11*g*, 211*g*, 311*g* may not necessarily be limited to those mentioned above. The plates 11*g*, 211*g*, 311*g* may be made of a material different from the plate 11*f*.

For another example, the plate 11*f* may not necessarily have the bars 11*fz*.

For another example, the through holes 11*dx*, 11*dy*, 11*fy*, 311*ey* may not necessarily be through holes that are formed through the plates 11*d*, 11*d*, 11*f*, 311*e*, respectively, but may be downward dents with bottoms. Moreover, the shapes of the through holes 11*fy*, 311*ey* may not necessarily be similar to the shape of the through hole 11*d*y.

For another example, the edges of the through hole 11*fy* may not necessarily encompass the outlines of the through hole 11*dy* entirely, but the edges of the through hole 11*fy* may be located on the outer sides of the edges of the through hole 11*dy*.

For another example, in the first embodiment, the distance D1 may be smaller than or equal to the distance D2 (see FIG. 3).

For another example, the thickness of the plate 11*f* may be smaller than or equal to the thickness of the plate 11*e* (see FIG. 3).

For another example, a quantity of the common flow paths may not necessarily be limited to two (2) but may be one (1), three (3), or more.

For another example, the damper sheets may be omitted from the common flow paths. For example, in the first embodiment, the damper sheets 11*h* and the plate 11*g* may be omitted, and a plate to close the through holes 11*fy* may be adhered to the lower face of the plate 11*f*.

For another example, the individual flow paths to communicate with the same common flow path may be arrayed alternately in zigzag along the first direction.

For another example, a quantity of nozzle(s), a quantity of the pressure chamber(s), and a quantity of the connecting flow path(s) in each individual flow path may not necessarily be limited to one (1) but may be two (2) or more.

For another example, the liquid discharging head may not necessarily be limited to the line-printing head but may be a serially discharging head that may discharge the liquid at a discharging target through a nozzle while the head moves in a scanning direction parallel to a width of the target.

For another example, the discharging target may not necessarily be limited to a sheet of paper but may be, for example, a piece of fabric or a board.

For another example, the liquid to be discharged through the nozzle(s) may not necessarily be limited to ink but may be any other liquid. For example, a processing agent to agglutinate or precipitate components in the ink may be discharged.

For another example, the head described in the present disclosure may be applicable not only to a printer but also to, for example, a facsimile machine, a copier, and a multifunction peripheral. Further, the heads described in the present disclosure may be applicable to a liquid discharging apparatus that may be usable in a purpose different from image recording, such as a liquid discharging apparatus to discharge electrically conductive liquid form a conductive pattern on a board.

What is claimed is:

1. A liquid discharging head, comprising:

a plurality of individual flow paths, each of which includes a nozzle, a pressure chamber, and a connecting flow path arranged between the nozzle and the pressure chamber, the connecting flow path connecting the nozzle with the pressure chamber;

a common flow path;

a first member, in which a plurality of first holes each constituting the connecting flow path and a second hole constituting the common flow path are formed;

a second member arranged at a side of the connecting flow path opposite to the pressure chamber in an aligning direction, in which the nozzle, the connecting flow path, and the pressure chamber align with one another, the second member having a third hole that constitutes the common flow path but does not constitute the connecting flow path;

a third member; and a damper sheet arranged between the second member and the third member, the damper sheet closing the third hole, wherein the third hole encompasses the second hole entirely.

2. The liquid discharging head according to claim 1, wherein the third hole is in a similar shape as the second hole.

3. The liquid discharging head according to claim 1, wherein the third member is made of a same material as the second member.

4. The liquid discharging head according to claim 1, wherein the third member is in a same size and a same shape as the second member.

5. The liquid discharging head according to claim 1, wherein the second member includes a first wall defining the third hole;

wherein the third member includes a second wall overlapping the first wall in the aligning direction; and wherein a width of the first wall is greater than a width of the second wall.

6. The liquid discharging head according to claim 1, wherein, in a range overlapping the pressure chamber in the aligning direction, a distance between an edge of the third hole and an edge of the second hole is greater than a distance between the edge of the third hole and the nozzle.

7. The liquid discharging head according to claim 1, further comprising:

a nozzle plate arranged at the same side of the connecting flow path as the second member in the aligning direction, the nozzle plate having the nozzle formed therein, wherein a length of the second member in the aligning direction is greater than a length of the nozzle plate in the aligning direction.

8. The liquid discharging head according to claim 1, wherein the nozzle is formed in the second member.

9. The liquid discharging head according to claim 1, wherein the second member includes a bar dividing the third hole.

10. A liquid discharging head, comprising:

a first plate having through holes, each of which constitutes a pressure chamber;

a second plate having through holes, each of which constitutes a nozzle;

a third plate arranged between the first plate and the second plate, the third plate having:

through holes, each of which constitutes a connecting flow path, the connecting flow path connecting the pressure chamber with the nozzle; and a through hole constituting a common flow path;

a fourth plate arranged on a side of the third plate opposite to the second plate in an aligning direction, in which the first plate, the second plate, and the third plate align with one another, the fourth plate not having a through hole to constitute the connecting flow path but having a through hole that constitutes the common flow path;

a fifth plate arranged on a side of the fourth plate opposite to the third plate in the aligning direction; and a damper sheet interposed between the fourth plate and the fifth plate.

11. The liquid discharging head according to claim 10, wherein the fourth plate includes a first wall, the first wall defining the through hole in the fourth plate that constitutes the common flow path;

wherein the fifth plate includes a second wall, the second wall overlapping the first wall in the aligning direction; and wherein a width of the first wall is greater than a width of the second wall.

12. The liquid discharging head according to claim 10, wherein the through hole in the fourth plate constituting the common flow path is larger than the through hole in the third plate constituting the common flow path.

13. The liquid discharging head according to claim 10, wherein the through hole in the fourth plate constituting the common flow path encompasses the through hole in the third plate constituting the common flow path entirely.

14. A liquid discharging head, comprising:

a first plate having through holes, each of which constitutes a pressure chamber;

a second plate having through holes, each of which constitutes a nozzle;

a third plate arranged between the first plate and the second plate, the third plate having:

through holes, each of which constitutes a connecting flow path, the connecting flow path connecting the pressure chamber with the nozzle; and a through hole constituting a common flow path; and a fourth plate arranged on a side of the third plate opposite to the second plate in an aligning direction, in which the first plate, the second plate, and the third plate align with one another, the fourth plate not having a through hole to constitute the connecting flow path but having a through hole that constitutes the common flow path, wherein the through hole in the fourth plate constituting the common flow path encompasses the through hole in the third plate constituting the common flow path entirely.

* * * * *